US006213372B1

(12) United States Patent
Chen

(10) Patent No.: US 6,213,372 B1
(45) Date of Patent: Apr. 10, 2001

(54) DRIVE DEVICE FOR A NAILING MACHINE

(76) Inventor: Mu-Yu Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/638,698

(22) Filed: Aug. 14, 2000

(51) Int. Cl.[7] ..... B25C 1/04

(52) U.S. Cl. ..... 227/8; 227/130

(58) Field of Search ..... 227/130, 8

(56) References Cited

U.S. PATENT DOCUMENTS

| | | | | |
|---|---|---|---|---|
| 5,551,621 | * | 9/1996 | Valles | 227/130 |
| 5,692,663 | * | 12/1997 | Yang | 227/8 |
| 5,791,545 | * | 8/1998 | Lin | 227/130 |
| 5,797,533 | * | 8/1998 | Lee | 227/8 |
| 5,836,501 | * | 11/1998 | Lai | 227/8 |
| 5,862,969 | * | 1/1999 | Lee | 227/130 |
| 6,059,161 | * | 5/2000 | Chang et al. | 227/130 |
| 6,116,488 | * | 9/2000 | Lee | 227/8 |

* cited by examiner

*Primary Examiner*—Scott A. Smith

(74) *Attorney, Agent, or Firm*—Alan Kamrath; Rider Bennett Egan & Arundel, LLP

(57) ABSTRACT

A nailing machine comprises a housing containing a nail hitting mechanism for hitting nails, a contact arm for pressing against a work, a trigger lever having an end pivotally connected to the housing, a contact lever having a lower end pivotally connected to the trigger lever and an upper end actuatable by the contact arm when the contact arm is pressed against the work, and a pressing member comprising a first end pivotally connected to the trigger lever and a second end. The pressing member further comprises an arcuate portion on a side thereof. When the contact arm is firstly pressed against the work and the trigger lever is pulled subsequently to activate the nail hitting mechanism via transmission by the contact lever, the arcuate portion of the pressing member bears against the housing such that the contact lever is immobile when the contact arm is disengaged from the work and when the trigger lever is kept pulled after hitting the nail to the work. The nailing machine is thus in a one-shot mode. When the trigger lever is firstly pulled such that the second end of the trigger lever bears against the housing, and the contact arm is subsequently pressed against the work and thus actuates the contact lever to activate the nail hitting mechanism for hitting a nail, the contact lever is returned to its original position when the contact arm is disengaged from the work and when the trigger lever is kept pulled after hitting the nail. The nailing machine is thus in a successive nailing mode.

3 Claims, 7 Drawing Sheets

DRIVE DEVICE FOR A NAILING MACHINE

BACKGROUND OF THE INVENTION

1. Field of the Invention

The present invention relates to a drive device for a nailing machine for allowing the nailing machine to be operated in a successive nailing mode or a one-shot nailing mode.

2. Description of the Related Art

A wide variety of nailing machines has heretofore been provided. An example of which is U.S. Pat. No. 5,597,106 issued to Hamano, et al. on Jan. 28, 1997 that discloses a drive device for a nailing machine. The drive device allows the nailing machine to be operated in a successive nailing mode or a one-shot nailing mode. Yet, the structure of the drive device is relatively complicated. The present invention is intended to provide a simpler design for the drive device.

SUMMARY OF THE INVENTION

A nailing machine in accordance with the present invention comprises:

a housing containing a nail hitting mechanism for hitting nails;

a contact arm for pressing against a work;

a trigger lever having an end pivotally connected to the housing;

a contact lever having a lower end pivotally connected to the trigger lever and an upper end actuatable by the contact arm when the contact arm is pressed against the work; and a pressing member comprising a first end pivotally connected to the trigger lever and a second end, the pressing member further comprising an arcuate portion on a side thereof;

whereby when the contact arm is firstly pressed against the work and the trigger lever is pulled subsequently to activate the nail hitting mechanism via transmission by the contact lever, the arcuate portion of the pressing member bears against the housing such that the contact lever is immobile when the contact arm is disengaged from the work and when the trigger lever is kept pulled after hitting the nail to the work, the nailing machine being thus in a one-shot mode; and whereby when the trigger lever is firstly pulled such that the second end of the trigger lever bears against the housing, and the contact arm is subsequently pressed against the work and thus actuates the contact lever to activate the nail hitting mechanism for hitting a nail, the contact lever is returned to its original position when the contact arm is disengaged from the work and when the trigger lever is kept pulled after hitting the nail, the nailing machine being thus in a successive nailing mode.

The housing comprises an indent and a corner adjacent to the indent. The arcuate portion of the pressing member is pressed against the corner of the housing and the second end of the pressing member enters the indent when the contact arm is pressed against the work and when in the one-shot nailing mode.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
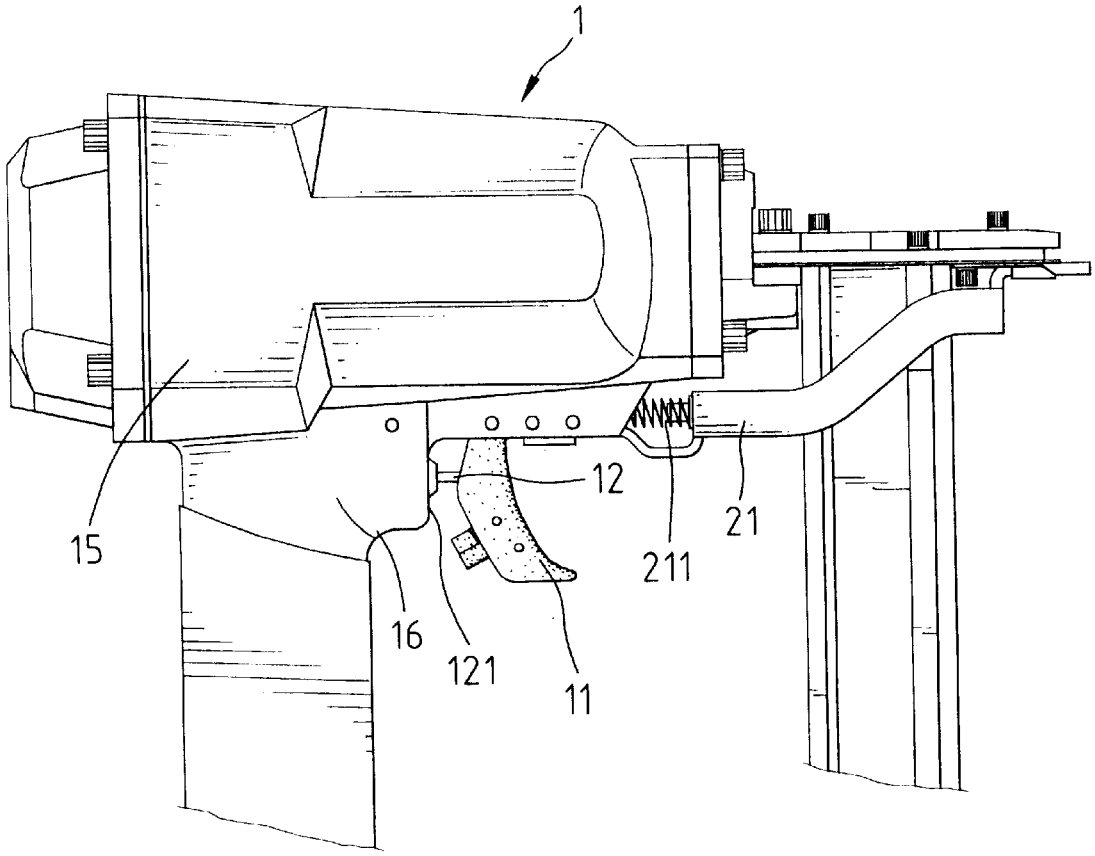
FIG. 1 is a perspective view of a nailing machine with a drive device in accordance with the present invention.
Figure 2:
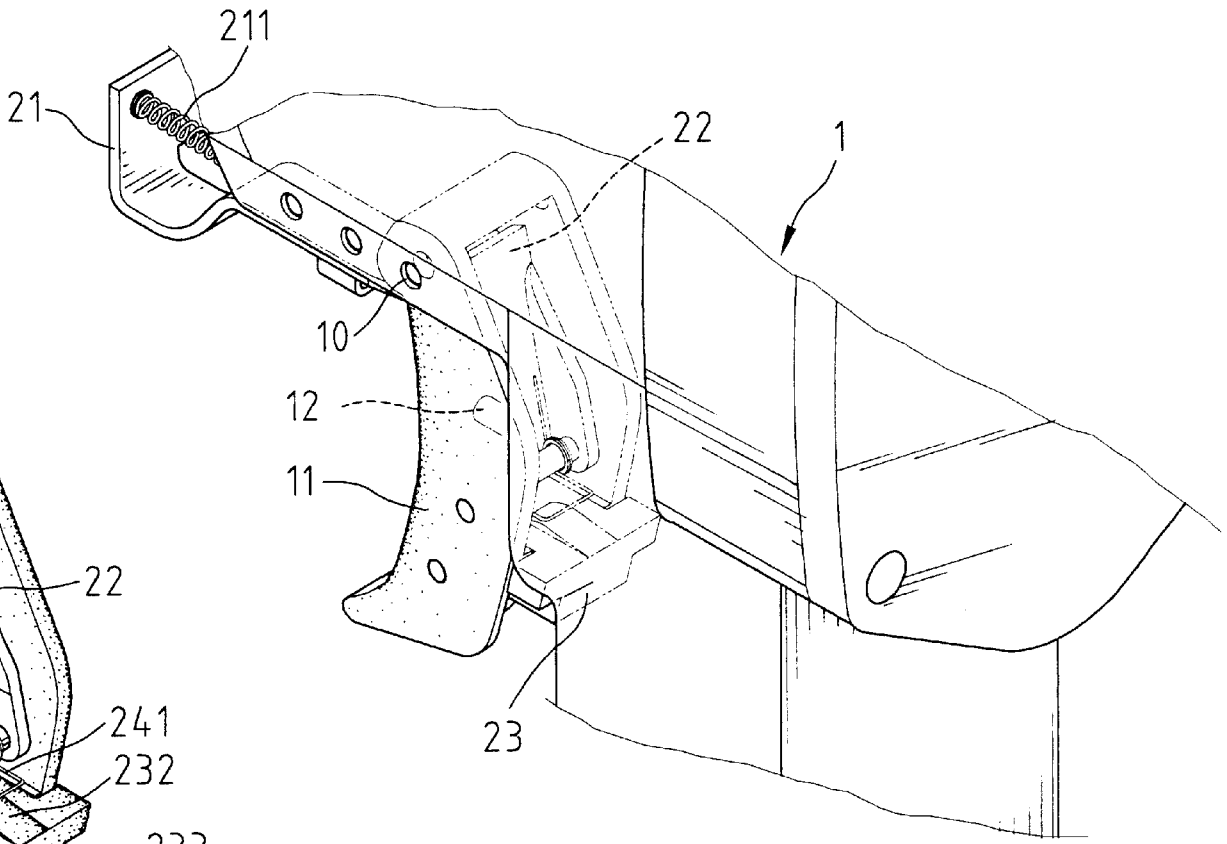
FIG. 2 is a partial perspective view of the nailing machine in accordance with the present invention.
Figure 2A:
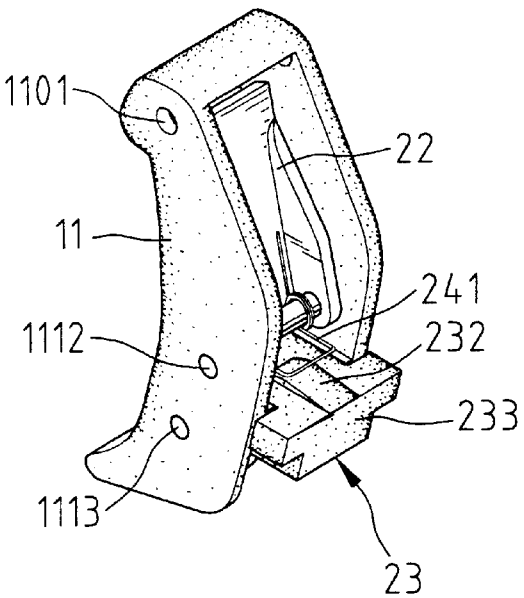
FIG. 2A is a perspective view of the drive device in accordance with the present invention.

Referring to FIGS. 1, 2, 2A, and 3, a nailing machine 1 generally comprises a housing 15 containing a nail hitting mechanism (not shown) and a drive valve (not shown) for driving the nail hitting mechanism. The nailing machine 1 comprises a drive device in accordance with the present invention. The nailing machine 1 includes a contact arm 21 that is pressed against a work (nail receiving member) when desired. The nailing machine 1 includes a spring 211 is provided for returning the contact arm 21 to its original position. The drive device for the nailing machine 1 includes a trigger lever 11 to which a contact lever 22 and a pressing member 23 are attached. The housing 15 includes an indent 16 and a corner 121 adjacent to the indent 16.

Figure 3:
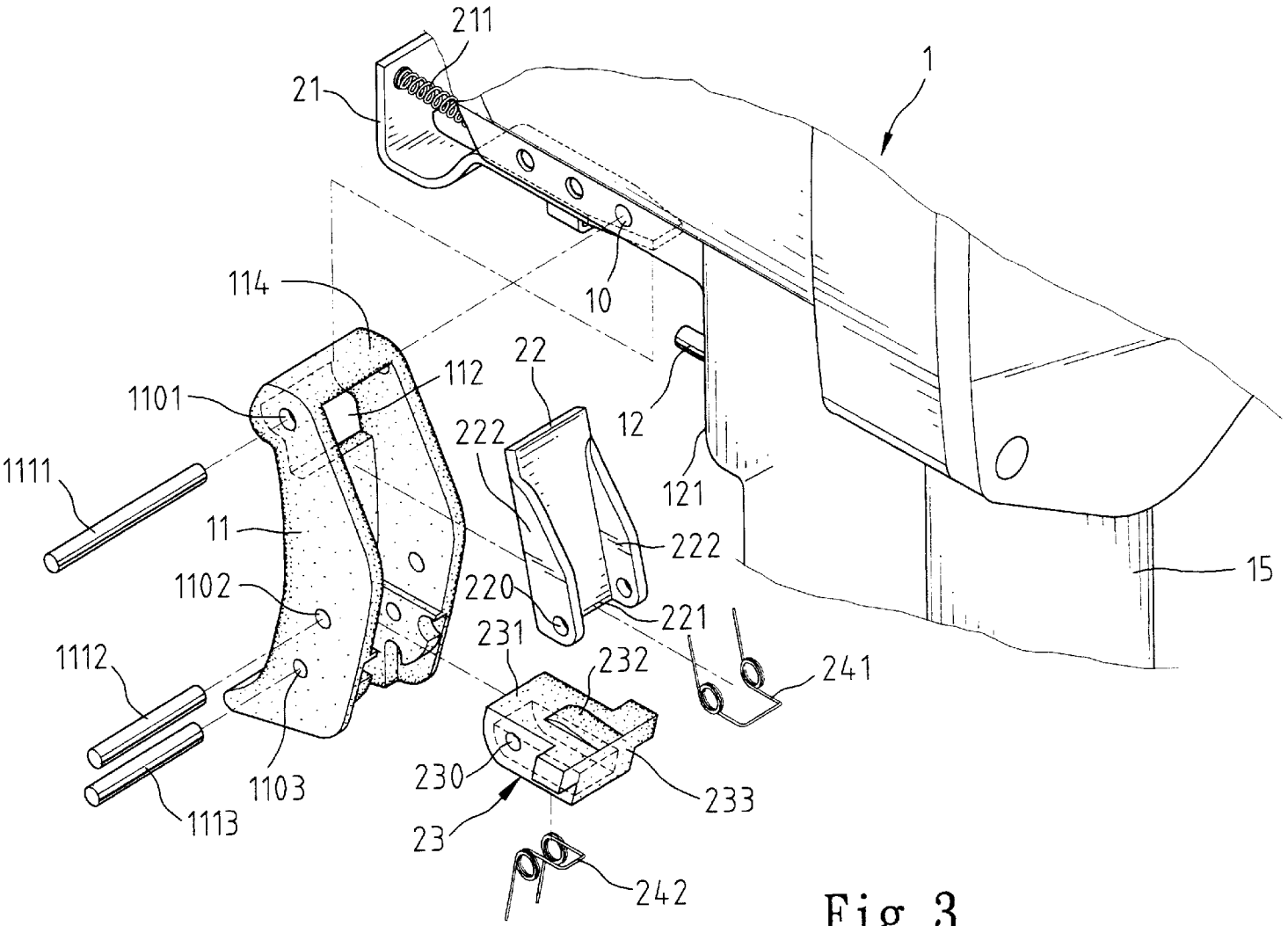
FIG. 3 is a partial perspective view, partly exploded, of the nailing machine in accordance with the present invention.

As illustrated in FIG. 3, the trigger lever 11 includes first, second, and third pin holes 1101, 1102, and 1103. A pin 1111 is extended through the pin holes 1101 in the trigger lever 11 and a pin hole 10 in the housing 15, thereby pivotally attaching an upper end 114 of the trigger lever 11 to the housing 15. The upper end 114 of the trigger lever 11 includes an opening 112 through which the contact arm 21 extends to thereby be in contact with an upper end of the contact lever 22, best shown in FIG. 4. The contact lever 22 includes two lateral wings 222 having a space therebetween. The lateral wings 222 include aligned pin holes 220 in lower ends thereof. A pin 1112 is extended through the pin holes 1102 of the trigger lever 11 and the pin holes 220 of the contact lever 22, thereby pivotally attaching a lower end 221 of the contact lever 22 to a mediate portion of the trigger lever 11.

Figure 4:
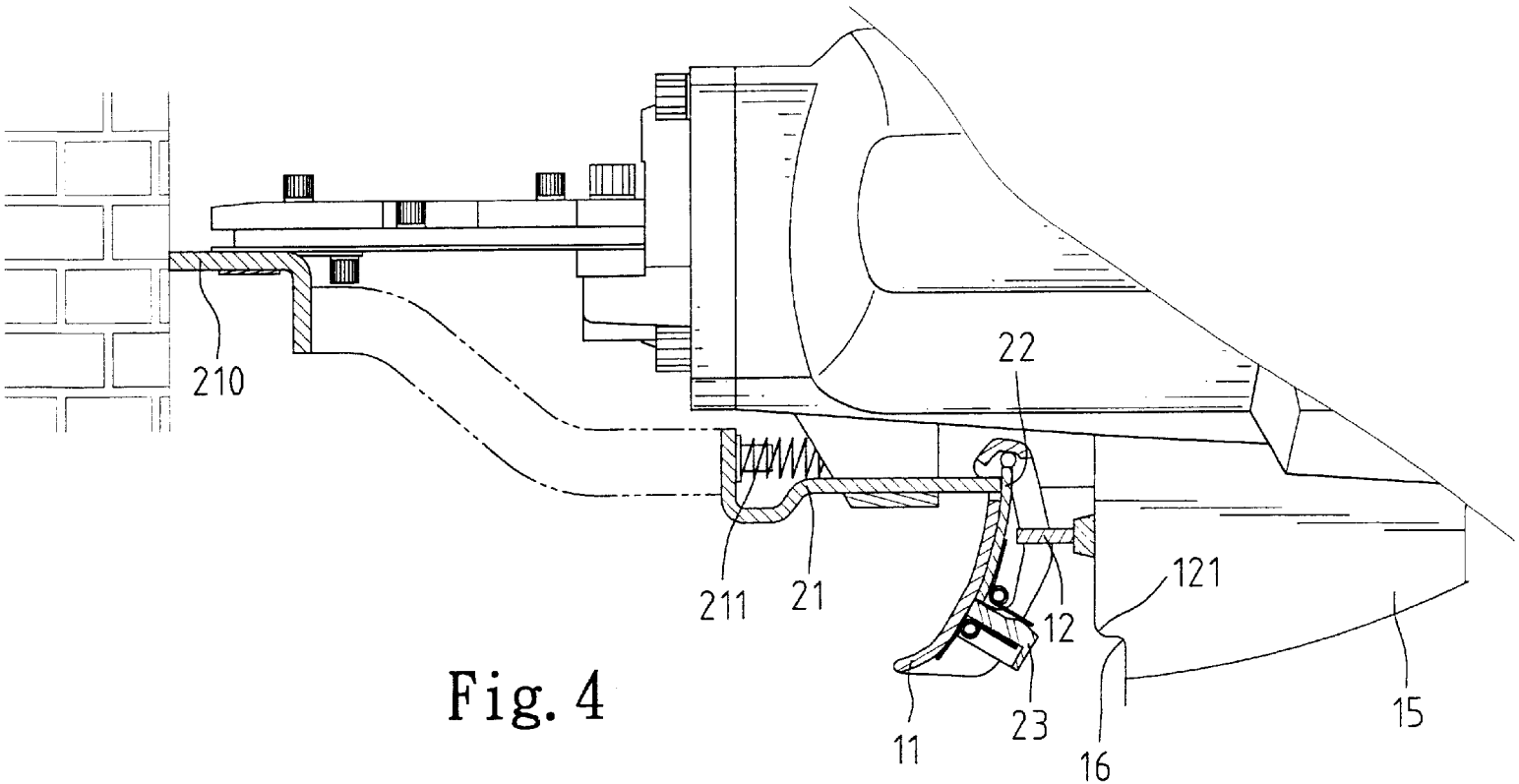
FIG. 4 is a partial sectional view of the nailing machine in accordance with the present invention, wherein the nailing machine is in a one-shot mode wherein the contact arm is going to press against an work to be nailed and the trigger lever is not pulled.

Still referring to FIG. 3, the pressing member 23 includes a hole 230 in a first end 231 thereof. A pin 1113 is extended through the pin holes 1103 of the trigger lever 11 and the pin hole 230 of the pressing member 23. Springs 241 and 242 are provided to the contact lever 22 and the pressing member 23 for returning the contact lever 22 and the pressing member 23 to their original positions, respectively. As illustrated in FIG. 4, the pressing member 23 is located below the contact lever 22 with an end face 233 of a second end of the pressing member 23 facing the housing 15 of the nailing machine 1. The pressing member 23 further includes an arcuate portion 232 (FIG. 3) on a side thereof.

Figure 5:
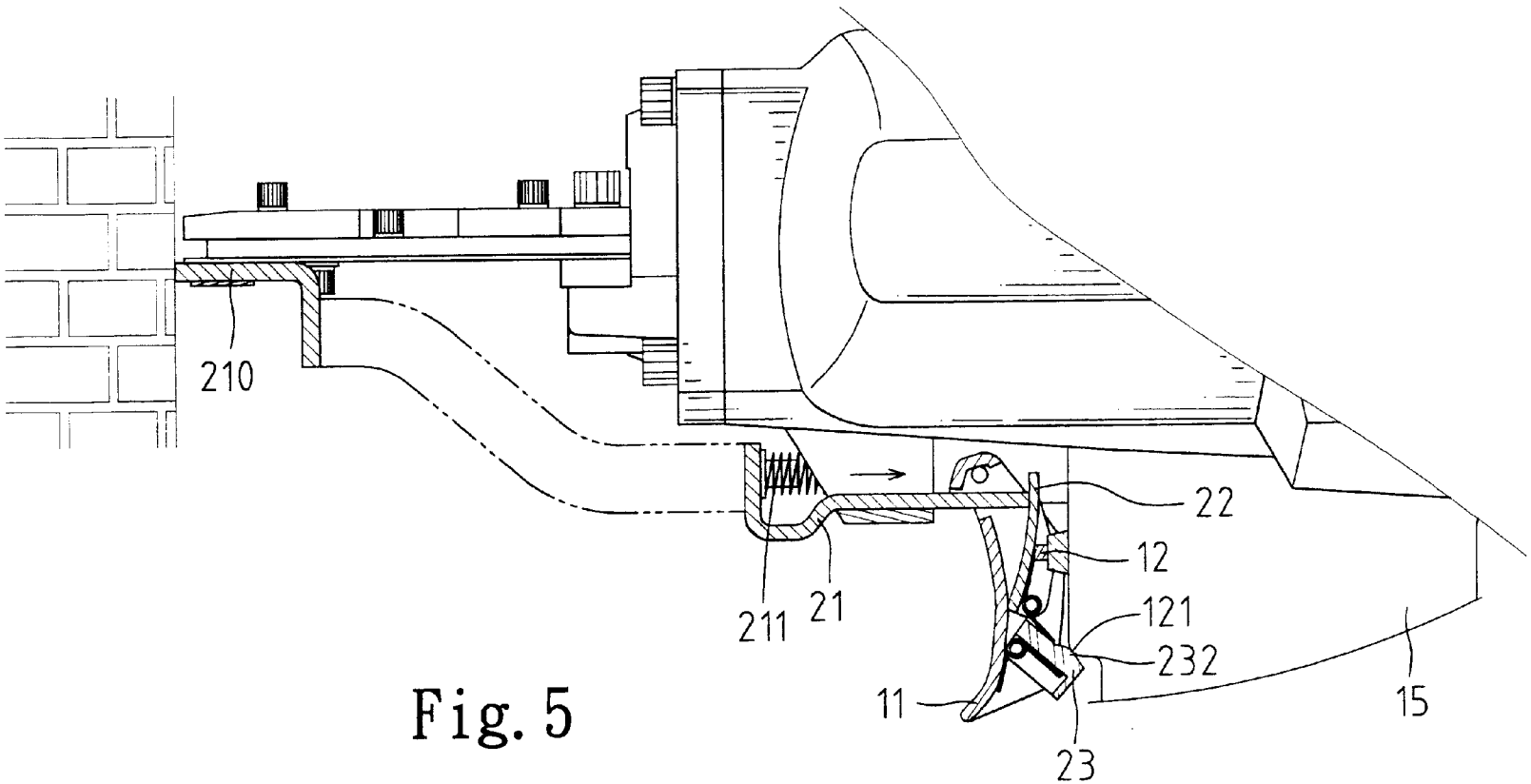
FIG. 5 is a sectional view similar to FIG. 4, wherein contact arm has been pressed against the work and the trigger lever is then pulled.

When in a one-shot nailing mode, the trigger lever 11 is not pulled before a front end 210 of the contact arm 21 is pressed against the work. As illustrated in FIG. 4, the nailing machine is in a one-shot mode wherein the front end 210 of the contact arm 21 is going to press against a work (not labeled) to be nailed and the trigger lever 11 is not pulled. Referring to FIG. 5, when the front end 210 of the contact arm 21 has been pressed against the work and the trigger lever is pulled subsequently, the contact lever 22 is moved rightward to actuate a trigger valve stem 12 of the drive valve that actuates the nail hitting mechanism. It is noted that even though the trigger lever 11 is kept pulled in a position shown in FIG. 5, the arcuate portion 232 of the pressing member 23 bears against the corner 121 of the housing 15 such that the contact lever 22 and the trigger valve stem 12 are immobile even if the front end 210 of the contact arm 21 is disengaged from the work. Namely, the spring 211 may return the contact arm 21 when the front end 210 of the contact arm 21 is disengaged from the work, yet the contact lever 22 and the trigger valve stem 12 cannot be returned, as they are retained in place. Thus, the nailing machine operates in a one-shot nailing mode even though the trigger lever 11 is kept pulled. The second end of the pressing member 23 enters the indent 16 when in the one-shot mode.

Figure 6:
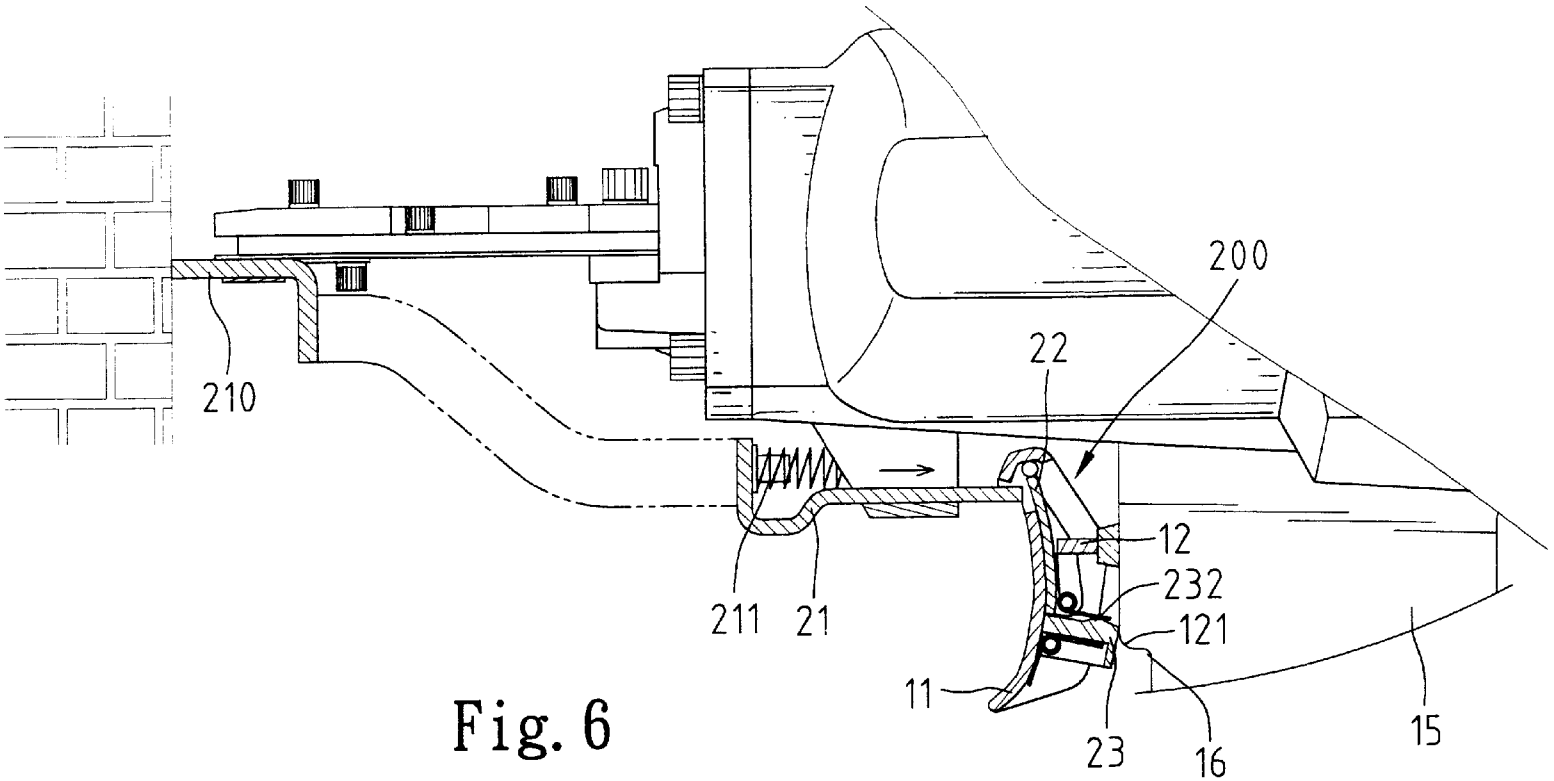
FIG. 6 is a sectional view similar to FIG. 4, wherein the nailing machine is in a successive nailing mode wherein the trigger lever is pulled firstly yet the contact arm has not yet been pressed against the work.
Figure 7:
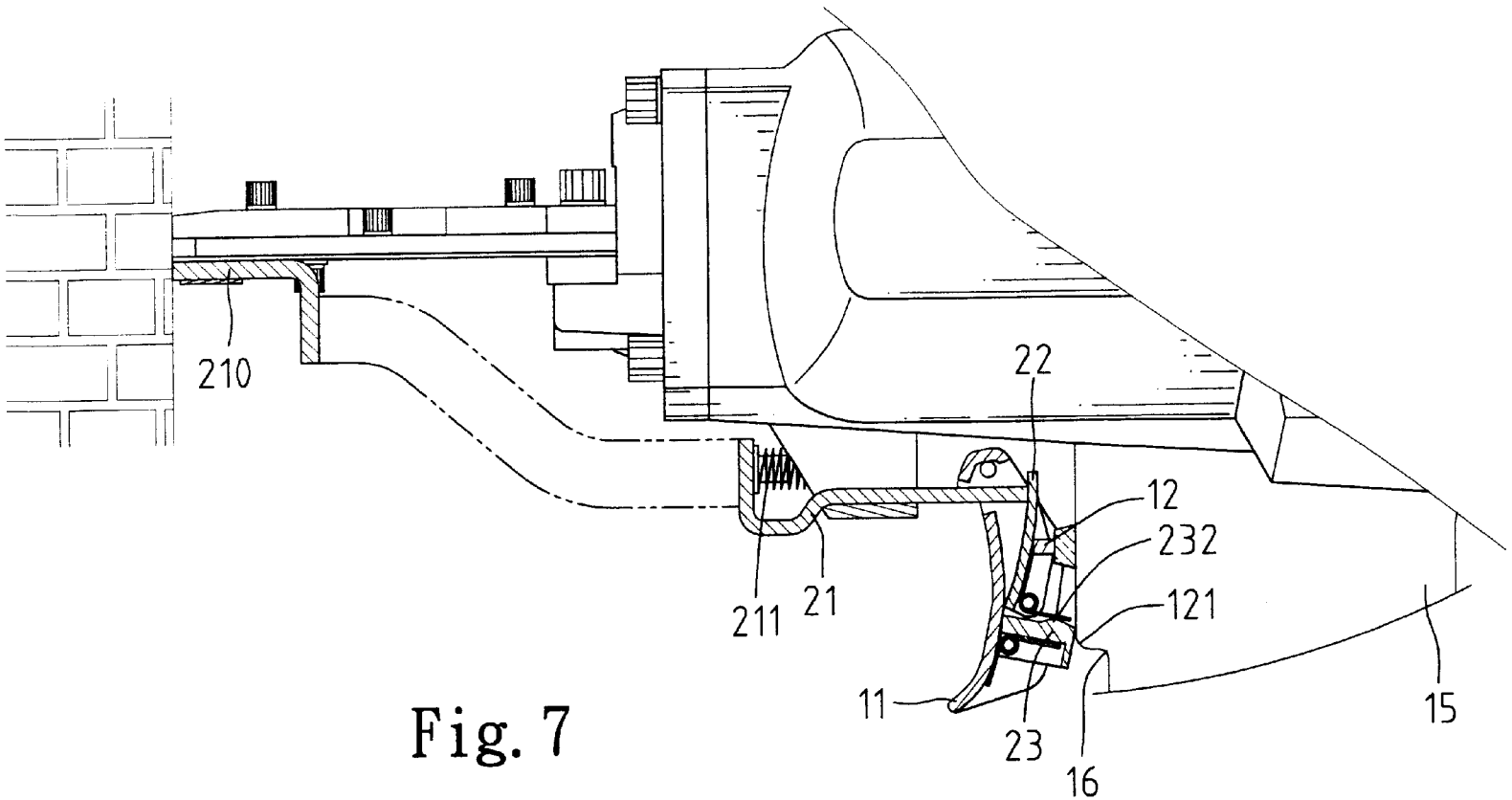
FIG. 7 is a sectional view similar to FIG. 6, wherein the contact arm has been pressed against the work.

When successive nailing mode is required, referring to FIG. 6, the trigger lever 11 is pulled firstly before the front end 210 of the contact arm 21 presses against the work. It is noted that the pressing member 23 bears against the corner 121 of the housing 15 at the end face 233 thereof instead of the arcuate portion 232. A fixed space 200 is defined between the trigger lever 11 and the housing 15. Referring to FIG. 7, when the front end 210 of the contact arm 21 is pressed against the work, the contact lever 22 is moved rightward to actuate the trigger valve stem 12 of the drive valve that actuates the nail hitting mechanism. After hitting a nail to the work, the front end 210 of the contact arm 21 is disengaged from the work and moves forward to its original position. The contact lever 22 and the trigger valve stem 12 also return to their original positions. A successive nailing mode is obtained if the trigger lever 11 is kept pulled by the user for hitting nails successively.

According to the above description, it is appreciated that the drive device in accordance with the present invention allows the nailing machine to be operated in a successive nailing mode or a one-shot nailing mode, yet the overall arrangement is much simpler.

Although the invention has been explained in relation to its preferred embodiment, it is to be understood that many other possible modifications and variations can be made without departing from the scope of the invention as hereinafter claimed.

What is claimed is:

1. A nailing machine comprising:

a housing containing a nail hitting mechanism for hitting nails;

a contact arm for pressing against a work;

a trigger lever having an end pivotally connected to the housing;

a contact lever having a lower end pivotally connected to the trigger lever and an upper end actuatable by the contact arm when the contact arm is pressed against the work; and a pressing member comprising a first end pivotally connected to the trigger lever and a second end, the pressing member further comprising an arcuate portion on a side thereof, whereby when the contact arm is firstly pressed against the work and the trigger lever is pulled subsequently to activate the nail hitting mechanism via transmission by the contact lever, the arcuate portion of the pressing member bears against the housing such that the contact lever is immobile when the contact arm is disengaged from the work and when the trigger lever is kept pulled after hitting the nail to the work, the nailing machine being thus in a one-shot mode; and whereby when the trigger lever is firstly pulled such that the second end of the trigger lever bears against the housing, and the contact arm is subsequently pressed against the work and thus actuates the contact lever to activate the nail hitting mechanism for hitting a nail, the contact lever is returned to its original position when the contact arm is disengaged from the work and when the trigger lever is kept pulled after hitting the nail, the nailing machine being thus in a successive nailing mode.

2. The nailing machine as claimed in claim 1, wherein the housing comprises an indent and a corner adjacent to the indent, the arcuate portion of the pressing member being pressed against the corner of the housing and the second end of the pressing member entering the indent when the contact arm is pressed against the work and when in the one-shot nailing mode.

3. The nailing machine as claimed in claim 2, wherein the nail hitting mechanism comprises a trigger valve stem actuatable by the contact lever.

* * * * *